US007162424B2

(12) United States Patent
Holzapfel et al.

(10) Patent No.: US 7,162,424 B2
(45) Date of Patent: Jan. 9, 2007

(54) METHOD AND SYSTEM FOR DEFINING A SEQUENCE OF SOUND MODULES FOR SYNTHESIS OF A SPEECH SIGNAL IN A TONAL LANGUAGE

(75) Inventors: Martin Holzapfel, München (DE); Jianhua Tao, München (DE)

(73) Assignee: Siemens Aktiengesellschaft, Munich (DE)

( * ) Notice: Subject to any disclaimer, the term of this patent is extended or adjusted under 35 U.S.C. 154(b) by 769 days.

(21) Appl. No.: 10/132,731

(22) Filed: Apr. 26, 2002

(65) Prior Publication Data

US 2002/0188450 A1 Dec. 12, 2002

(30) Foreign Application Priority Data

Apr. 26, 2001 (DE) ..... 101 20 513

(51) Int. Cl.

| | |
|---|---|
| ***G10L 13/00*** | (2006.01) |
| ***G10L 21/00*** | (2006.01) |
| ***G10L 13/08*** | (2006.01) |
| ***G10L 13/06*** | (2006.01) |

(52) U.S. Cl. ..... 704/258; 704/260; 704/268; 704/278

(58) Field of Classification Search ..... 704/258, 704/260, 268, 278

See application file for complete search history.

(56) References Cited

U.S. PATENT DOCUMENTS

| | | | | |
|---|---|---|---|---|
| 5,502,790 | A | 3/1996 | Yi | |
| 5,636,325 | A * | 6/1997 | Farrett | 704/258 |
| 5,845,047 | A | 12/1998 | Fukada et al. | |
| 5,905,971 | A | 5/1999 | Hovell | |
| 5,905,972 | A * | 5/1999 | Huang et al. | 704/268 |
| 6,173,261 | B1 | 1/2001 | Arai et al. | |
| 6,175,819 | B1 | 1/2001 | Van Alstine | |
| 6,182,039 | B1 | 1/2001 | Rigazio et al. | |
| 6,185,529 | B1 | 2/2001 | Chen et al. | |
| 6,195,638 | B1 | 2/2001 | Ilan et al. | |
| 6,208,963 | B1 | 3/2001 | Martinez et al. | |
| 6,240,347 | B1 | 5/2001 | Everhart et al. | |
| 6,243,683 | B1 | 6/2001 | Peters | |
| 6,246,989 | B1 | 6/2001 | Polcyn | |
| 6,292,779 | B1 | 9/2001 | Wilson et al. | |
| 6,304,848 | B1 | 10/2001 | Singer | |

(Continued)

FOREIGN PATENT DOCUMENTS

| | | |
|---|---|---|
| DE | 694 27 083 | 1/1995 |

(Continued)

OTHER PUBLICATIONS

Mittrapiyanuruk, Pradit/ Hansakunbuntheung, Chatchawarn/ Tesprasit, Virongrong/□□Sornlertlamvanich, Virach. "Improving naturalness of Thai text-to-speech synthesis by□□prosodic rule." In ICSLP-2000(Oct. 16-20), vol. 3, pp.: 334-337.*

(Continued)

*Primary Examiner*—Richemond Dorvil
*Assistant Examiner*—Thomas E Shortledge
(74) *Attorney, Agent, or Firm*—Staas & Halsey LLP

(57) ABSTRACT

The invention relates to a method for defining a sequence of sound modules for synthesis of a speech signal in a tonal language corresponding to a sequence of speech modules. The method according to the invention differs from known methods in that the speech modules represent triphones, which each comprise one phoneme with the respective context, and with syllables in the tonal language being composed of one or more triphones. This results in a high level of flexibility for the synthesis of tonal languages.

20 Claims, 4 Drawing Sheets

U.S. PATENT DOCUMENTS

| | | | | |
|---|---|---|---|---|
| 6,317,717 | B1 | 11/2001 | Lindsey et al. | |
| 6,321,195 | B1 | 11/2001 | Lee et al. | |
| 6,505,158 | B1 * | 1/2003 | Conkie | 704/260 |
| 6,665,641 | B1 * | 12/2003 | Coorman et al. | 704/260 |
| 6,778,964 | B1 | 8/2004 | Geiger et al. | |
| 6,826,533 | B1 | 11/2004 | Burchard et al. | |
| 2001/0011218 | A1 | 8/2001 | Philips et al. | |
| 2001/0011302 | A1 | 8/2001 | Son | |
| 2001/0012997 | A1 | 8/2001 | Erell | |
| 2001/0032075 | A1 | 10/2001 | Yamamoto | |

FOREIGN PATENT DOCUMENTS

| | | |
|---|---|---|
| DE | 199 26 740 | 12/2000 |
| DE | 199 38 649 | 2/2001 |
| DE | 199 40 940 | 3/2001 |
| DE | 199 42 871 | 3/2001 |
| DE | 199 43 875 | 3/2001 |
| DE | 199 53 875 | 5/2001 |
| DE | 199 57 430 | 5/2001 |
| DE | 199 62 218 | 7/2001 |
| DE | 199 63 899 | 7/2001 |
| DE | 100 02 321 | 8/2001 |
| DE | 100 03 529 | 8/2001 |
| DE | 100 06 008 | 8/2001 |
| DE | 100 06 240 | 8/2001 |
| DE | 100 06 725 | 8/2001 |
| DE | 100 09 279 | 8/2001 |
| DE | 100 08 226 | 9/2001 |
| DE | 100 12 572 | 9/2001 |
| DE | 100 14 337 | 9/2001 |
| DE | 100 15 960 | 10/2001 |
| DE | 100 16 696 | 10/2001 |
| DE | 100 47 613 | 10/2001 |
| DE | 100 24 942 | 11/2001 |
| EP | 0 674 307 | 1/2001 |
| EP | 1 081 682 | 3/2001 |
| EP | 1 094 445 | 4/2001 |
| EP | 1 100 075 | 5/2001 |
| WO | WO 97/42626 | 11/1997 |
| WO | WO99/10878 | 3/1999 |
| WO | WO 00/19409 | 4/2000 |
| WO | WO 01/01389 | 1/2001 |
| WO | WO 01/01391 | 1/2001 |
| WO | WO 01/16936 | 3/2001 |
| WO | WO 01/33553 | 5/2001 |
| WO | WO 01/35390 | 5/2001 |
| WO | WO 01/39178 | 5/2001 |
| WO | WO 01/41125 | 6/2001 |
| WO | WO 01/75862 | 10/2001 |
| WO | WO 01/80221 | 10/2001 |

OTHER PUBLICATIONS

Bhaskararao, P., Eady, S.J., Esling, J.H. "Use of triphones for demisyllable-based speech □□synthesis". Acoustics, Speech, and Signal Processing, 1991. ICASSP-91., 1991 International□□Conference on Apr. 14-17, 1991 pp.: 517-520 vol. 1.*

Mittrapiyanuruk, Pradit/Hansakunbuntheung, Chatchawarn/ Tesprasit, Virongrong/ Sornlertlamvanich, Virach. "Improving naturalness of Thai test-to-speech synthesis by prosodic rule." In ICSLP-2000 (Oct. 16-20), vol. 3, pp. 334-337.

Bhaskararao, P., Eady, S.J., Esling, J.H. "Use of triphones for demisyllable- based speech synthesis". Acoustics, Speech, and Signal Processing, 1991. ICASSP-91., 1991 International Conference on Apr. 14-17, 1991 pp. 517-520 vol. 1.

* cited by examiner

METHOD AND SYSTEM FOR DEFINING A SEQUENCE OF SOUND MODULES FOR SYNTHESIS OF A SPEECH SIGNAL IN A TONAL LANGUAGE

CROSS REFERENCE TO RELATED APPLICATIONS

This application is based on and hereby claims priority to German Application No. 10120513.9 filed on Apr. 26, 2001, the contents of which are hereby incorporated by reference.

BACKGROUND OF THE INVENTION

1. Field of the Invention

The invention relates to a method for defining a sequence of sound modules for synthesis of a speech signal in a tonal language, corresponding to a predetermined sequence of speech modules.

2. Description of the Related Art

Automatic methods, carried out by computers, for synthesis of tonal languages, such as Chinese, in particular Mandarin or Thai, normally use sound modules which each represent one syllable, since tonal languages generally have relatively few syllables. These sound modules are concatenated to form a speech signal, in which process it is necessary to take into account the fact that the significance of the syllables is dependent on the pitch.

Since these known methods have a set of sound modules which must include all the syllables in various variants and contexts, a considerable amount of computation power is required in a computer to carry out this process automatically. This computation power is often not available in mobile telephone applications.

In applications with a high level of computation power, the known methods for synthesis of tonal languages have the disadvantage that the given set of syllables does not allow correct synthesis of specific expressions which contain syllables that are not stored in this set, even though sufficient computation power may be available.

These known methods have been proven in practice. However, they are not very flexible since they frequently cannot be adapted to applications where there is little computation power and they do not fully utilize capabilities provided by high computation parallels.

A method for language synthesis, which relates to synthesis of European languages, is explained in the thesis "Konkatenative Sprachsynthese mit groβen Datenbanken" [Concatenated speech synthesis using large databanks], Martin Holzapfel, TU Dresden, 2000. In this method, individual sounds are stored in their specific left-to-right context as sound modules. Based on "The HTK book, version 2.2" Steve Young, Dan Kershaw, Julian Odell, Dave Ollason, Valtcho Valtchev and Phil Woodland, Entropic Ltd., Cambridge 1999, these sound modules are referred to as triphones. In this sense, triphones are sound modules of an individual phon, although it is necessary to take account of the context of a preceding phon and of a subsequent phon in this case.

In this known method, a group of sound modules (triphones) is stored in a databank for each speech module, which generally comprises one letter. Suitability functions are used to determine suitability distances for sound modules in the respective speech modules, with the suitability distances quantitatively describing the suitability of the respective sound module for representation of the speech module, or of the sequence of the speech modules. The suitability distances can in this case be determined using the following criteria:

representativeness of the sound modules;
manipulation of the sound duration;
manipulation of the sound energy;
manipulation of the fundamental frequency.

When determining the representativeness of the sound modules, a typical spectral centroid of the group of sound modules is defined and a value which is indirectly proportional to the spectral distance between the respective sound module and the centroid is defined as the suitability distance.

When sound modules are concatenated, the fundamental frequency must be manipulated, as a result of which the sound duration and sound energy are also influenced. The corresponding suitability functions are used to determine a measure of the discrepancy from the original state of the sound module as a result of the manipulation.

A method for determining a sound module which is representative of the speech module is known from DE 197 36 465.9. In this document, the suitability functions are referred to as association functions, and the suitability distance is referred to as the selection measure. Otherwise, this method corresponds to the method described in the thesis cited above.

SUMMARY OF THE INVENTION

An object of the invention is to define a sequence of sound modules for synthesis of a speech signal in a tonal language, corresponding to a predetermined sequence of speech modules, with a high level of flexibility.

This object is achieved by a method of defining a sequence of sound modules for synthesis of a speech signal in a tonal language, corresponding to a predetermined sequence of speech modules, in which a group which contains the sound modules that can be associated with the speech module, is chosen corresponding to each of the speech modules in the predetermined sequence, and a sound module is in each case selected from the respective groups of sound modules for each speech module in that a suitability distance from the predetermined speech module is defined for each of the sound modules in a group on the basis of at least one suitability function, and the individual suitability distances in a predetermined sequence of sound modules are concatenated with one another to form a global suitability distance, with the global suitability distance quantitatively describing the suitability of the respective sequence of sound modules for representation of the respective sequence of speech modules, and with the sequence of sound modules with the best suitability distance being associated with the predetermined sequence of speech modules, in which case the sound modules comprise triphones, which each represent only one phoneme with the respective contexts, and the syllables in the tonal language are composed of one or more triphones.

The invention thus provides a method in which the syllables of a tonal language can be composed of triphones. In this case, the principle which is used for synthesis of tonal languages in conventional methods, in which the speech signal is regarded as being composed only of sound modules which describe complete syllables, is not used, and syllables are also composed of triphones. This makes it possible to synthesize syllables very flexibly by sound modules.

According to one preferred embodiment, a function which describes the capability to concatenate two adjacent sound modules is used as the suitability function, with the value of this suitability function at syllable boundaries being reduced in comparison to the regions within syllables. This means that the capability to concatenate triphones has a lower weighting at syllable boundaries, so that triphones with a relatively low concatenation capability can be concatenated with one another at syllable boundaries.

According to a further preferred exemplary embodiment, a function which describes the match between the pitch level at the transition from one sound module to an adjacent sound module is used as the suitability function. This results in the pitch level being matched.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
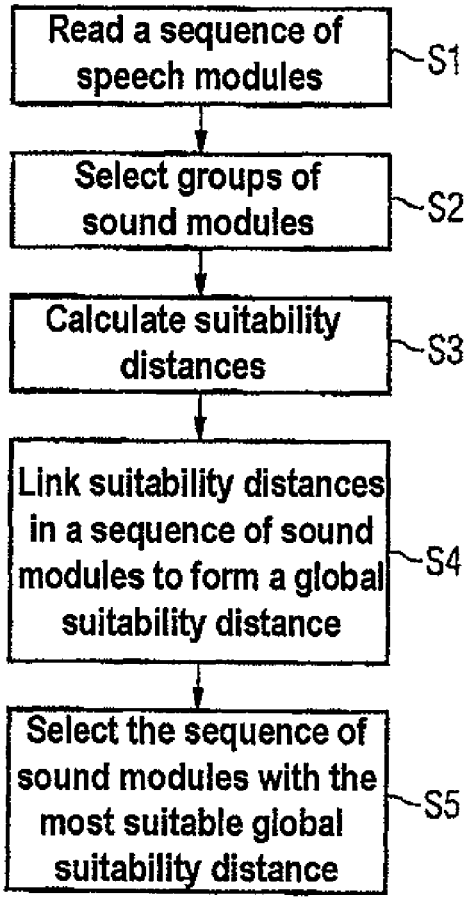
FIG. 1 is a flowchart of a method for defining a sequence of sound modules for synthesis of a speech signal.

Reference will now be made in detail to the preferred embodiments of the present invention, examples of which are illustrated in the accompanying drawings, wherein like reference numerals refer to like elements throughout.

A text to be synthesized is normally in the form of an electronically legible file. This file contains written characters in a tonal language, such as Mandarin. As illustrated in FIG. 1, first these written characters are converted in step S1 to the spoken sounds associated with the written characters, with each character in the spoken sounds representing a phoneme or the like.

Next, a group of sound modules is associated (step S2) with each phoneme. These sound modules are produced and stored in advance, during a training phase, by segmentation of a sample of speech. Such a sampling of speech can be segmented, for example, by fast Viterbi alignment. Each triphone results in a number of suitable sound modules, which are each combined in a group. These groups are then associated with the respective triphones A sequence of suitable groups of sound modules is determined in step S2. These sound modules are associated with the respective phonemes, with their left-hand and right-hand context. These phonemes with the left-hand and right-hand context are referred to as triphones, and represent the speech modules of the text to be synthesized.

Figure 2:
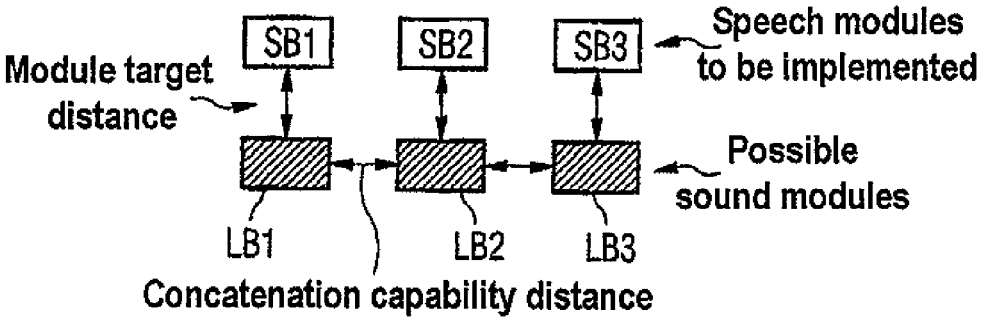
FIG. 2 is a schematically block diagram of a relationship between partial suitability functions and sound and speech modules.

Partial suitability functions, which each result in suitability distances, are calculated in step S3. The suitability distances quantitatively describe the suitability of the respective sound module for representation of the following speech module, or of the sequence of speech modules. FIG. 2 shows, schematically, three speech modules SB1, SB2, SB3 to be implemented and three possible sound modules LB1, LB2, LB3. The sound module LB1 is a member of the group which is associated with the speech module SB1. A corresponding situation applies to the pairs SB2, LB2 and SB3, LB3.

The suitability of a sound module for representing a specific speech module may depend on different criteria. In principle, these criteria may be subdivided into two classes. The criteria in the first class govern the suitability of a specific sound module LB1 being able to represent a specific speech module SB1, per se. Since a sequence of speech modules must in each case be converted to a corresponding sequence of sound modules, and sound modules cannot be concatenated with one another in an uncontrolled manner, since undesirable artifacts can occur at the corresponding transitions from one sound module to the other sound module, the second class of criteria represents the suitability of the individual sound modules for concatenation. In this sense, a distinction is drawn between a module target distance between the individual sound modules and the speech modules and a concatenation capability distance between the individual sound modules. The partial suitability functions are explained in more detail further below.

In step S4, the suitability distances for a sequence of sound modules are linked to form a global suitability distance. In the exemplary embodiment according to the invention, the value range of all the suitability functions covers the value from 0 to 1, with 1 corresponding to optimum suitability and 0 to minimum suitability. The partial suitability functions can therefore be linked to one another by multiplication using the following formula:

$$E_{global} = \prod_{Modules} \prod_{Criteria} E_{partial} \tag{1}$$

According to this formula, all the partial suitability distances $E_{partial}$ of the individual suitability functions (criteria) for each module are multiplied by one another, and the products which are obtained in the process for each module are in turn multiplied to form the global suitability distance $E_{global}$. The global suitability distance $E_{global}$ thus describes the suitability of a sequence of sound modules for representing a sequence of specific speech modules. The value range of the global suitability function is once again in the range from 0 to 1, with 0 corresponding to minimum suitability, and 1 to maximum suitability.

In step S5, a sequence of sound modules is selected which is the most suitable for representing the predetermined sequence of speech modules. In the present exemplary embodiment, this is the sequence of sound modules whose global suitability distance $E_{global}$ has the greatest value.

Once the sequence of sound modules which is the most suitable for representing the predetermined sequence of speech modules has been determined, the speech can be produced by successively outputting the sound modules, in which case the sound modules can, of course, be manipulated and modified in a manner known per se.

Figure 3:
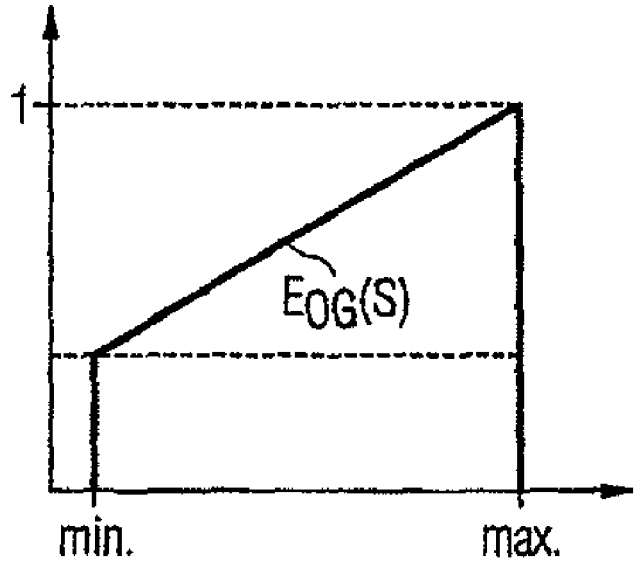
FIGS. 3–6 are graphs of partial suitability functions.

A number of partial suitability functions are described in more detail in the following text, and these can be used individually or in combination. FIG. 3 shows the profile of the partial suitability function $E_S$ which gives a module target distance as shown in FIG. 2, and thus describes the representativeness of the respective sound module for a predetermined speech module. It is thus a measure for the matching of a sound module as a representative, that is to say that a sound module to be selected is a typical, characteristically articulated sound module and is a suitable representative for the corresponding speech module.

The suitability function $E_S$ is assumed to be linear between the sound module with the "worst" ($E_S=1-S_G$) suitability distance and the "best" ($E_S=1$) suitability distance.

Figure 4:
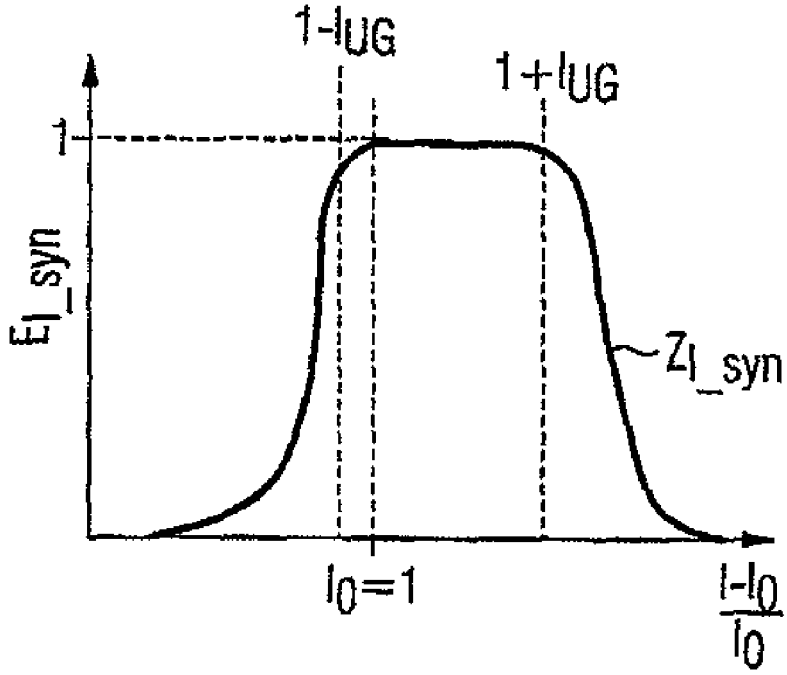

FIG. 4 is a graph of a suitability function which describes the length manipulation of the respective sound module by the adaptation of a specific fundamental frequency It is thus a measure of the original duration of the sound module relative to the synthesized duration of the sound module. Discrepancies within the range between a lower threshold value $l_{UG}$ and an upper threshold value $l_{OG}$ are regarded as not being problematic. Beyond these threshold values, that is to say below the lower threshold value $l_{UG}$ or above the upper threshold value $l_{OG}$, the partial suitability function $E_{l_syn}$ falls exponentially.

This suitability function $E_{l_syn}$ is described by the following formula:

$$E_{\mathrm{l_syn}}\left(\frac{l-l_\varnothing}{l_\varnothing}\right)=\begin{cases}\exp\left(-\frac{1}{2}\cdot\left(\frac{l-l_\varnothing+l_{UG}}{l_\varnothing}\cdot\frac{1}{l_{UG}}\right)^2\right) & \text{for } -l_{UG}>\frac{l-l_\varnothing}{l_\varnothing}\\ 1 & \text{for } -l_{UG}<\frac{l-l_\varnothing}{l_\varnothing}<l_{OG}\\ \exp\left(-\frac{1}{2}\cdot\left(\frac{l-l_\varnothing-l_{OG}}{l_\varnothing}\cdot\frac{1}{l_{OG}}\right)^2\right) & \text{for } l_{OG}<\frac{l-l_\varnothing}{l_\varnothing}\end{cases}. \tag{2}$$

The mean length $l_\varnothing$ is normalized with respect to unity in order to make the discrepancy relative. This partial suitability function $E_{l_syn}$ is also normalized with respect to unity, resulting in a module target distance.

Figure 5:
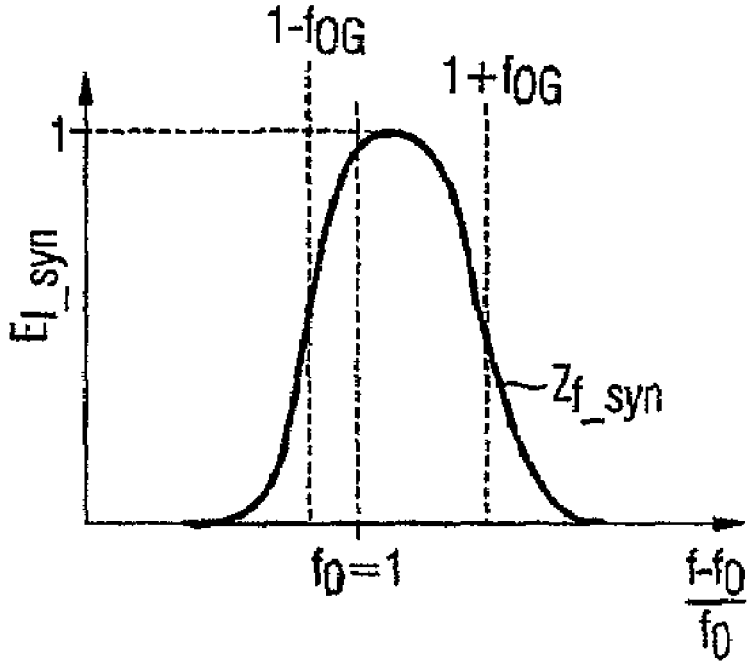

FIG. 5 shows a partial suitability function which describes the discrepancy between the pitch level of the sound module and a target fundamental frequency. The pitch level discrepancy relating to a pitch level associated with that sound module in the non-manipulated state should in this case be as small as possible. This partial suitability function $E_{f_syn}$ has the following form:

$$E_{\mathrm{f_syn}}\left(\frac{f-f_\varnothing}{f_\varnothing}\right)=\begin{cases}\exp\left(-\frac{1}{2}\cdot\left(\frac{f-f_\varnothing}{f_\varnothing}\cdot\frac{1}{f_{OG}}\right)^2\right) & \text{for } o>f-f_\varnothing\\ \exp\left(-\frac{1}{2}\cdot\left(\frac{f-f_\varnothing}{f_\varnothing}\cdot\frac{1}{f_{UG}}\right)^2\right) & \text{for } o<f-f_\varnothing\end{cases} \tag{3}$$

In this case as well, the frequency f is normalized with respect to the mid-frequency $f_\varnothing$. The suitability function $E_{f_syn}$ is normalized with respect to unity. An upper frequency parameter is defined as $f_{OG}$, and a lower frequency parameter as $f_{UG}$.

Figure 6:
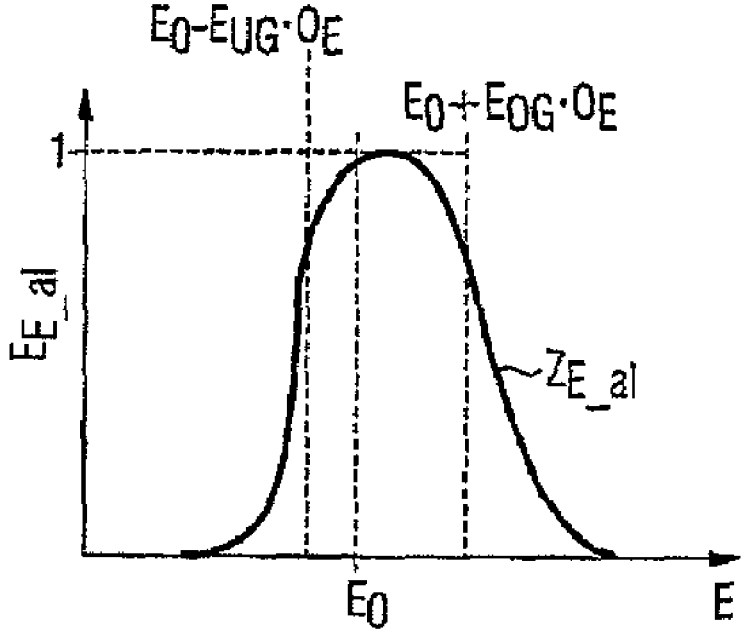

The partial suitability functions shown in FIG. 6 describe the discrepancy, which results from the adaptation of a sound module to a fundamental frequency, between the energy in the sound module and a mean value. This partial suitability function is represented by the following formula:

$$E_{\mathrm{E_al}}(E-E_\varnothing)=\begin{cases}\exp\left(-\frac{1}{2}\cdot\left(\frac{E-E_\varnothing}{E_\infty\cdot\sigma_E}\right)^2\right) & \text{for } O>E-E_\varnothing\\ \exp\left(-\frac{1}{2}\cdot\left(\frac{E-E_\varnothing}{E_{UG}\cdot\sigma_E}\right)^2\right) & \text{for } O<E-E_\varnothing\end{cases} \tag{4}$$

In this case, $E_\varnothing$ is the mean value (expected value) of the energy E, $E_{UG}$ is a lower energy threshold, $E_{OG}$ is an upper energy threshold, and $\sigma_E$ is the energy variance. The suitability function $E_{E_al}$ is normalized with respect to unity.

The length l of the sound module can be used as the criterion instead of the energy. Analogously to FIG. 5, this results in a partial suitability function $E_{l_al}$ for assessment of the relative discrepancy in the length change of the sound module owing to the adaptation to the fundamental frequency. An upper threshold $l_{OG}$, a lower threshold $l_{UG}$ and a variance for the length sl are once again predetermined, so that the suitability function $E_{l_al}$ can be represented by the following formula:

$$E_{\mathrm{zl_al}}(l-l_\varnothing)=\begin{cases}\exp\left(-\frac{1}{2}\cdot\left(\frac{l-l_\varnothing}{l_\infty\cdot\sigma_l}\right)^2\right) & \text{for } o>l-l_\varnothing\\ \exp\left(-\frac{1}{2}\cdot\left(\frac{l-l_\varnothing}{l_{OG}\cdot\sigma_l}\right)^2\right) & \text{for } o<l-l_\varnothing\end{cases} \tag{5}$$

The partial suitability functions explained above each result in a module target distance. These suitability functions may be considered individually or in combination for assessment of the sound modules.

Figure 7:
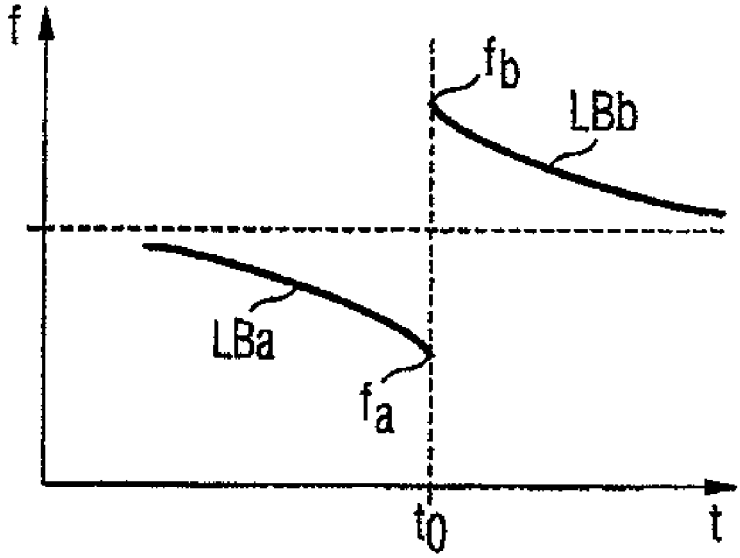
FIG. 7 is a graph of the pitch level of two mutually adjacent sound modules.

The partial suitability function $E_{f_syn}$ explained above is used to assess the discrepancy between the fundamental frequency f of the sound module and a target fundamental frequency $f_\varnothing$. For synthesis of a tonal language, it is expedient to use a partial suitability function that is modified from this and which assesses the difference between the frequencies of two successive sound modules at their junction point. FIG. 7 shows, schematically, the frequency profile for two successive sound modules LBa and LBb. The sound module LBa ends, and the sound module LBb starts, at time t0. There is a frequency difference Δf at this time, since the sound module LBa at the frequency $f_a$ ends at the time t0, at which the sound module LBb at the frequency $f_b$ starts. In tonal languages, the pitch level is associated with meaning content. The pitch level or frequency of the individual sound modules is thus of fundamental importance for understanding of the synthesized speech. Furthermore, large frequency differences at the transition from one sound module to another sound module result in the formation of artifacts. It is therefore worthwhile assessing the frequency difference between two successive sound modules, with a small frequency difference representing good suitability. A partial suitability function such as this can be formulated, for example, as follows $$E_{\mathrm{f_syn}}\left(\frac{f_a-f_b}{(f_a+f_b)/2}\right)= \tag{6}$$

-continued $$\begin{cases} \exp\left(-\frac{1}{2}\cdot\left(\frac{f_a-f_b}{(f_a+f_b)/2}\cdot\frac{1}{f'_{OG}}\right)^2\right) & \text{for } o>f_a-f_b \\ \exp\left(-\frac{1}{2}\cdot\left(\frac{f_a-f_b}{(f_a+f_b)/2}\cdot\frac{1}{f'_{UG}}\right)^2\right) & \text{for } o<f_a-f_b \end{cases}$$

In this case as well, it is once again necessary to provide an upper parameter for the frequency $f'_{OG}$ and a lower parameter for the frequency $f'_{UG}$.

Since this partial suitability function is used to determine a suitability distance between two successive sound modules, this suitability distance represents a concatenation capability distance in the sense of FIG. 2.

Further partial suitability functions for describing the concatenation capability of successive sound modules are known from the prior art (see the thesis "Konkatenative Sprachsynthese mit groβen Datenbanken", which can be translated as "Concatenated speech synthesis using large databanks", by Martin Holzapfel, TU Dresden, 2000). The partial suitability functions may be used in combination with the above suitability function $E_V$, or else individually, in the method according to the invention.

However, for the purposes of the invention, it is expedient to weight the suitability functions $E_V$, which describe the concatenation suitability, as a function of the region in which the concatenation boundary is located. For example, the concatenation suitability between two sound modules of a syllable is considerably more important than at the syllable boundary, or at the word or sentence boundary. Since, in the present exemplary embodiment, the value range of the partial suitability functions is between 0 and 1, it is possible to obtain a weighted suitability function $Eg_V$ by applying a weighting factor to the power of the unweighted suitability function $E_V$:

$$Eg_V=(E_V)^{g_n} \tag{7}$$

In this case, $g_n$ is the weighting factor. The higher the chosen weighting factor, the more important is the concatenation suitability between two successive sound modules. Suitable values for weighting factors are, for example, $g_1=0$ at sentence boundaries, $g_2=[2, 5]$ at word boundaries, $g_3=[5, 100]$ at syllable boundaries and $g_4>>1000$ within a syllable. The value of the concatenation function $E_V$ thus has a weighting factor $g_n$ applied to its power, for which reason small values of $E_V$ with a high weighting factor result in a weighted suitability distance close to 0. For the weighting factor values stated above, only an unweighted suitability distance which is only slightly less than unity can be assessed as being suitable for selection of the corresponding sound modules.

The use of such a weighting results in the concatenation of only those sound modules within a syllable which "match" one another very well. Syllables are thus in this way produced by individual sound modules or triphones. At syllable boundaries, on the other hand, the unweighted concatenation suitability may be correspondingly lower as a result of the low weighting. The weighting is once again downgraded somewhat at word boundaries. The use of the weighting factor $g_1=0$ at sentence boundaries means that no concatenation suitability is necessary at sentence boundaries, that is to say two sound modules whose concatenation suitability distance is equal to 0 may follow one another at sentence boundaries.

Figure 8:
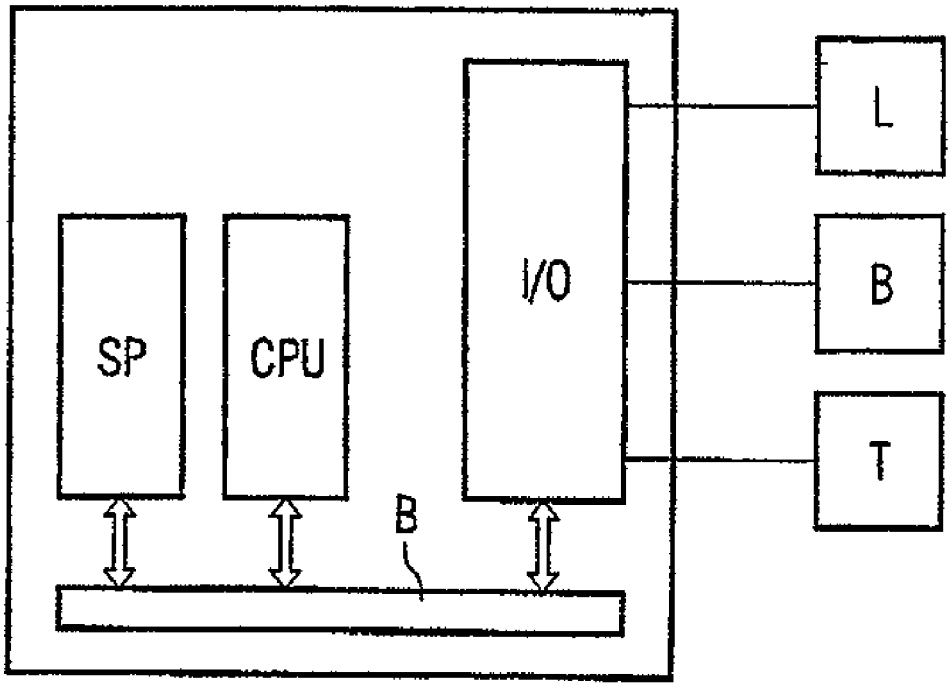
FIG. 8 is a block diagram of an apparatus for speech synthesis according to the present invention.

FIG. 8 shows the schematic design of a computer for carrying out the method according to the invention. The computer has a data bus B, to which a CPU and a data memory SP are connected. Furthermore, the bus B is connected to an input/output unit I/O, to which a loudspeaker L, a screen B and a keyboard T are connected. A program for carrying out the method according to the invention is stored in the data memory SP. Furthermore, a text file which contains the speech modules to be converted to sound modules can be entered in the data memory. The method according to the invention is then carried out by the CPU, with the speech modules being converted to sound modules and being output via the input/output unit on the loudspeaker L. In this case, of course, it is possible for the concatenated sound modules to be modified and to be altered using normal processing methods.

The essential feature for the invention is that the tonal language is composed of sound modules which describe triphones, thus resulting in maximum flexibility. For the purposes of the invention it is, of course, also possible for sound modules also to describe complete syllables in the tonal language. The essential feature is that sound modules which describe triphones may also be present, and may be concatenated in an appropriate manner. Particular account is preferably taken of the specific characteristics of a tonal language by the assessment of frequency differences at transitions from one sound module to a further sound module.

The structures of the tonal language are taken into account in an appropriate manner in the synthesization process by the weighting, according to the invention, of the suitability functions which describe the concatenation characteristics.

The invention has been described in detail with particular reference to preferred embodiments thereof and examples, but it will be understood that variations and modifications can be effected within the spirit and scope of the invention.

What is claimed is:

1. A method for defining a sequence of sound modules for synthesis of a speech signal in a tonal language in accordance with a predetermined sequence of speech modules, comprising:

choosing groups of sound modules which can be associated with the speech modules in the predetermined sequence; and selecting from the groups of sound modules a corresponding sound module for each speech module based on at least one suitability function defining a suitability distance from the speech module corresponding thereto and weighted by applying a weighting factor to a power thereof, resulting in the predetermined sequence of speech modules having a sequence of corresponding sound modules with a global suitability distance quantitatively describing a preferred suitability among the groups of sound modules for representation of the predetermined sequence of speech modules, each corresponding sound module being a triphone formed of only one phoneme with respective contexts and with each syllable in the tonal language being composed of at least one triphone.

2. The method as claimed in claim 1, wherein said selecting includes calculating a partial suitability distance for each corresponding sound module using a plurality of suitability functions; and multiplying the partial suitability distance for each corresponding sound module in the sequence of corresponding sound modules by one another to form the global suitability distance.

3. The method as claimed in claim 2, wherein the at least one suitability function describes a concatenation capability for two adjacent sound modules and has a value weighted differently at syllable boundaries than within syllables.

4. The method as claimed in claim 3, wherein the at least one suitability function describing the concatenation capability is also weighted at word and sentence boundaries.

5. The method as claimed in claim 1, wherein the weighting factor is greater than 1000 within syllables, and between 5 and 100 at syllable boundaries.

6. The method as claimed in claim 5, wherein the weighting factor is between 2 and 5 at word boundaries, and is equal to 0 at sentence boundaries.

7. The method as claimed in claim 6, wherein the suitability function describes a match between pitch levels of two adjacent sound modules.

8. The method as claimed in claim 7, wherein at least one partial suitability distance for each corresponding sound module is in a range from 0 to 1, with 1 corresponding to optimum suitability and 0 to minimum suitability.

9. A computer readable medium storing at least one program embodying a method for defining a sequence of sound modules for synthesis of a speech signal in a tonal language in accordance with a predetermined sequence of speech modules, said method comprising:

choosing groups of sound modules which can be associated with the speech modules in the predetermined sequence; and selecting from the groups of sound modules a corresponding sound module for each speech module based on at least one suitability function defining a suitability distance from the speech module corresponding thereto and weighted by applying a weighting factor to a power thereof, resulting in the predetermined sequence of speech modules having a sequence of corresponding sound modules with a global suitability distance quantitatively describing a preferred suitability among the groups of sound modules for representation of the predetermined sequence of speech modules, each corresponding sound module being a triphone formed of only one phoneme with respective contexts and with each syllable in the tonal language being composed of at least one triphone.

10. The computer readable medium as claimed in claim 9, wherein said selecting includes calculating a partial suitability distance for each corresponding sound module using a plurality of suitability functions; and multiplying the partial suitability distance for each corresponding sound module in the sequence of corresponding sound modules by one another to form the global suitability distance.

11. The computer readable medium as claimed in claim 10, wherein the at least one suitability function describes a concatenation capability for two adjacent sound modules and has a value weighted differently at syllable boundaries than within syllables.

12. The computer readable medium as claimed in claim 11, wherein the at least one suitability function describing the concatenation capability is also weighted at word and sentence boundaries.

13. The computer readable medium as claimed in claim 9, wherein the weighting factor is greater than 1000 within syllables, and between 5 and 100 at syllable boundaries.

14. The computer readable medium as claimed in claim 13, wherein the weighting factor is between 2 and 5 at word boundaries, and is equal to 0 at sentence boundaries.

15. The computer readable medium as claimed in claim 14, wherein the suitability function describes a match between pitch levels of two adjacent sound modules.

16. The computer readable medium as claimed in claim 15, wherein at least one partial suitability distance for each corresponding sound module is in a range from 0 to 1, with 1 corresponding to optimum suitability and 0 to minimum suitability.

17. A system for defining a sequence of sound modules for synthesis of a speech signal in a tonal language in accordance with a predetermined sequence of speech modules, comprising:

a processor programmed to choose groups of sound modules which can be associated with the speech modules in the predetermined sequence and to select from the groups of sound modules a corresponding sound module for each speech module based on at least one suitability function defining a suitability distance from the speech module corresponding thereto and weighted by applying a weighting factor to a power thereof, resulting in the predetermined sequence of speech modules having a sequence of corresponding sound modules with a global suitability distance quantitatively describing a preferred suitability among the groups of sound modules for representation of the predetermined sequence of speech modules, each corresponding sound module being a triphone formed of only one phoneme with respective contexts and with each syllable in the tonal language being composed of at least one triphone.

18. The system as claimed in claim 17, wherein the weighting factor is greater than 1000 within syllables, and between 5 and 100 at syllable boundaries.

19. The system as claimed in claim 18, wherein the weighting factor is between 2 and 5 at word boundaries, and is equal to 0 at sentence boundaries.

20. The system as claimed in claim 19, wherein the suitability function describes a match between pitch levels of two adjacent sound modules.

* * * * *